US005681421A

United States Patent [19]

Biagiotti

[11] Patent Number: 5,681,421

[45] Date of Patent: Oct. 28, 1997

[54] DEVICE FOR GLUING THE TAIL END OF A REEL OF WEB MATERIAL WITH VACUUM SYSTEMS FOR OPENING THE TAIL END

[75] Inventor: Guglielmo Biagiotti, Lucca, Italy

[73] Assignee: Fabio Perini S.p.A., Lucca, Italy

[21] Appl. No.: 501,117

[22] PCT Filed: Dec. 5, 1994

[86] PCT No.: PCT/IT94/00203

§ 371 Date: Aug. 9, 1995

§ 102(e) Date: Aug. 9, 1995

[87] PCT Pub. No.: WO95/15903

PCT Pub. Date: Jun. 15, 1995

[30] Foreign Application Priority Data

Dec. 10, 1993 [IT] Italy ..... F193A0255
May 26, 1994 [IT] Italy ..... FI94A0103

[51] Int. Cl.[6] ..... B65H 19/29

[52] U.S. Cl. ..... 156/446; 156/449; 156/455; 156/187; 156/578; 242/532.3

[58] Field of Search ..... 156/184, 187, 156/191, 446, 456, 457, 458, 449, 455, 578; 242/532.3

[56] References Cited

U.S. PATENT DOCUMENTS

| | | | |
|---|---|---|---|
| 3,393,105 | 7/1968 | Tellier . | |
| 4,102,304 | 7/1978 | Debenham . | |
| 4,475,974 | 10/1984 | Perini | 156/187 |
| 5,242,525 | 9/1993 | Biagiotti . | |

FOREIGN PATENT DOCUMENTS

| | | |
|---|---|---|
| 0623540 | 11/1994 | European Pat. Off. . |
| 1511076 | 10/1970 | Germany . |
| 14212095 | 8/1993 | Germany . |
| 50-35562 | 11/1975 | Japan . |
| 8102847 | 1/1983 | Netherlands . |

*Primary Examiner*—James Engel
*Attorney, Agent, or Firm*—Breiner & Breiner

[57] ABSTRACT

A device for gluing the tail end (LF) of a reel (L) of wound web material comprises: conveying means (5, 21) for moving the reel; unwinding means (7, 9) for unwinding the tail end of the web material; a dispenser (11) of glue (C) for applying the glue to the reel (L); and means for rewinding the tail end after the glue (C) has been applied. The unwinding means comprise a vacuum unit (51, 53) which detaches and unwinds the tail end of the web material from the reel by depression.

32 Claims, 11 Drawing Sheets

19
21
29
21I
17
63
LF
L1
9
43
13
5
11
41
47
C
61
7
B
51
53
A
3
L
1
f21

Fig. 3
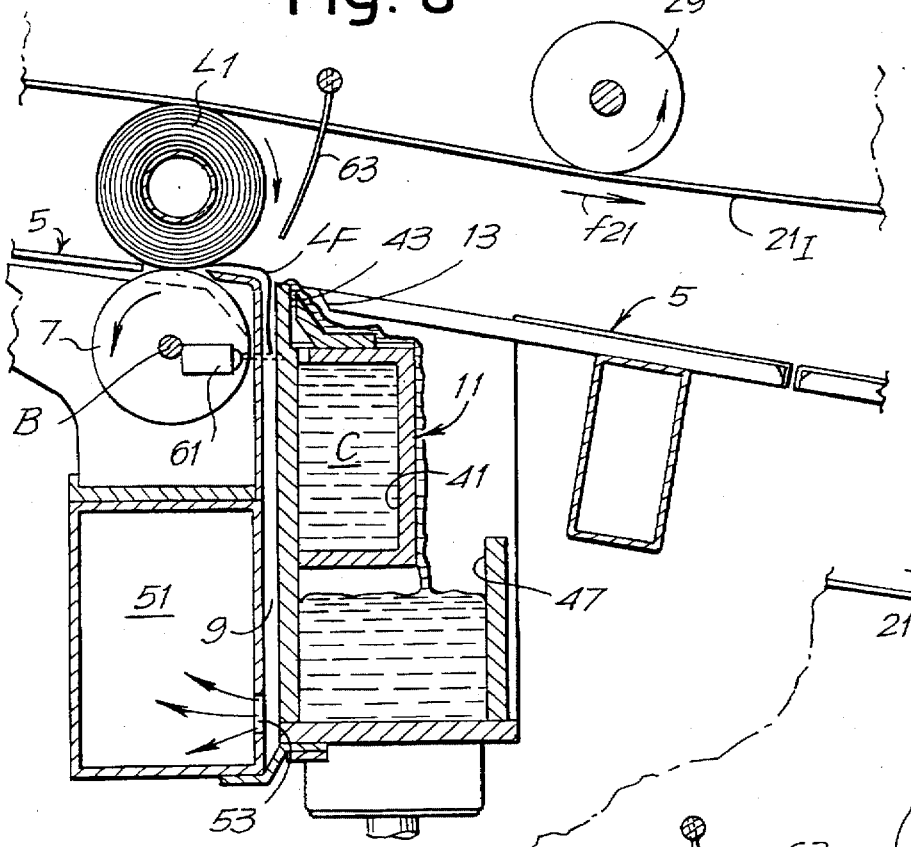
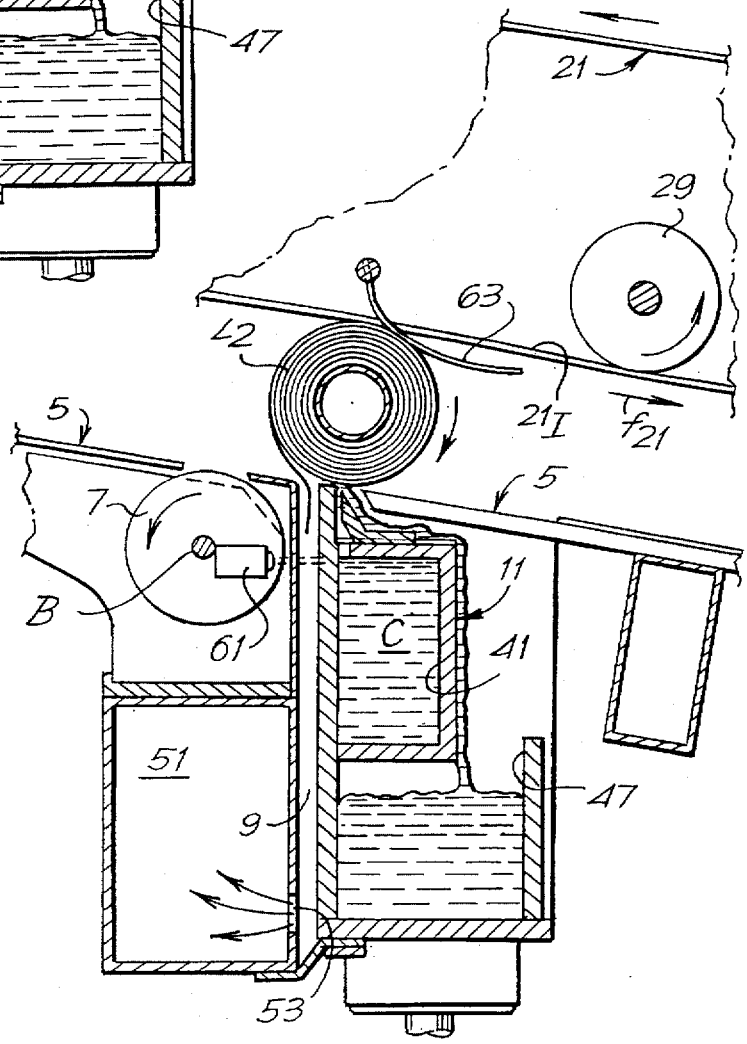
Fig. 4

210
L
205
207A
207
265
243
211
208
LF
263
206
208A
261
264
209
253
251

210
L
205
208
207
207A
209
265
243
211
LF
C
263
206
208A
261
264
209
253
251

DEVICE FOR GLUING THE TAIL END OF A REEL OF WEB MATERIAL WITH VACUUM SYSTEMS FOR OPENING THE TAIL END

TECHNICAL FIELD

The invention relates to a device for gluing the tail end of a reel or log of wound web material, of the type comprising: conveying means for moving the reel; unwinding means for unwinding the tail end of the web material; a dispenser of glue for applying a glue to the web material of the reel; and means for rewinding the reel after the glue has been applied. More particularly, the invention relates to a device of the above type in which the glue is applied to a portion of material still wound on the reel and onto which the free end is then rewound.

STATE OF THE ART

Various kinds of reel gluing devices exist, and, purely by way of illustration, those disclosed in, for example, U.S. Pat. No. 4,475,974, U.S. Pat. No. 4,963,223, U.S. Pat. No. 5,259,910 and U.S. Pat. No. 5,242,525 may be indicated. In all currently known gluing devices, and in particular in those disclosed in the patents cited above, the unwinding of the tail end of the web material before gluing takes place is achieved by holding the reel in an unwinding position and striking said reel with blasts of air emitted by nozzles in suitable positions and orientations. These blasts of air lift the tail end of the reel and open it onto a supporting surface. The reel is then made to rotate in order partly to rewind the tail end so that a predetermined and limited length of web material remains on the supporting surface. Once this has been done it is necessary to transfer the reel with the tail end in this position to the glue dispenser. In conventional gluing devices, disclosed for example in U.S. Pat. No. 4,963,223 or in U.S. Pat. No. 4,475,974, the reel is transferred by translationally moving a pair of rolls on which the reel is supported and, integrally with said rolls, the surface on which the tail end has been unwound. This is necessary because the glue is dispensed through nozzles directly onto the tail end which is then rewound onto the reel. In order to considerably simplify the gluing process, U.S. Pat. No. 5,242,525 and U.S. Pat. No. 5,259,910 disclose two novel gluing devices in which, once the tail end has been unwound from the reel, the reel is rolled over a slit through which the glue is continuously dispensed as it wells up. This makes it possible to achieve major simplifications and to greatly reduce maintenance, if not eliminate it altogether. Nonetheless, even in these innovative gluing devices, means are required to transfer the reel from the unwinding location to the gluing location. This is necessary because the tail end has to be unwound by the blasts of air and laid on a surface where the end is carried to the desired extent for partial rewinding onto the reel. It is therefore necessary to then move the reel from a position in which the unwinding surface is located to the gluing position.

DISCLOSURE OF THE INVENTION

It is an object of the present invention to provide a still more simplified gluing device that can be constructed with a smaller number of stations, and hence also with simpler and more compact reel transfer systems.

Basically, the device according to the invention is characterized in that the means for unwinding the tail end comprise a vacuum unit which detaches and unwinds the tail end of the web material from the reel by generating a depression in the area around the reel. In this way it is possible, as will be clear from the following detailed description, to position the glue dispenser in the immediate vicinity of the unwinding means, thereby making the device not only more compact but also simpler from the point of view of construction.

U.S. Pat. No. 5,242,525 discloses a vacuum system which captures the free end and transfers it to a space adjacent to the gluing device. However, in this case the free end has already been unwound from the reel by a conventional system of blowing nozzles. In contrast, according to the invention the preliminary stage of detaching and opening or partly unwinding the tail end of the web material is also done by vacuum means.

The device according to the invention can be embodied in various ways, adopting any hitherto known system of dispensing the glue, and in particular any of those referred to in the abovementioned patents. It is moreover clear that the chief advantage of adopting a vacuum unit for detaching and unwinding the tail end is obtained in combination with glue dispensing systems of the kind described in U.S. Pat. No. 5,259,910 and U.S. Pat. No. 5,242,525, since in this case it is possible to position a reel conveying and supporting surface, on which said reel is rolled so as to pass over a glue dispensing slit, directly downsteam of the vacuum unit. In this case the reel supporting and conveying surface may also extend upstream of the dispenser, and leading down underneath said surface there may be a vacuum space inside which the depression generated by the vacuum unit is produced, so that the tail end which is in contact with the external cylindrical surface of the reel is captured within the vacuum space and, by appropriately turning the reel about its own axis, the length of the tail end drawn into the vacuum space is adjusted to a predeterminable length, for example by means of a sensor in a suitable position inside the space. Once the desired length has been unwound, the reel is simply rolled along the supporting and conveying surface in such a way as to pass over the glue dispensing slit. As the reel rolls, the tail end is drawn out of the vacuum space and gradually rewound onto the external surface of the reel.

Advantageously, the unwinding means comprise reel retaining means that keep the reel in the unwinding position, and at least one drive roll which, as it rotates (being in contact with the external surface of the reel), causes the reel to rotate about its own axis and hence the unwinding and gradual and controlled rewinding of the tail end which is captured in the vacuum space. Various kinds of reel retaining members can be used, such as for example a movable stop which, when the required length has been unwound, is withdrawn upwards to allow the reel to advance. But in a preferred embodiment, the reel is retained by keeping said reel between the unwinding roll and a movable opposing surface which is in contact with the reel in a position diametrically opposite that in which the reel touches the unwinding roll. The speed of the movable opposing surface at the point of contact with the reel is equal and opposite to the peripheral speed of the roll so that the reel rolls about its own axis, remaining in contact between the opposing surface and the unwinding roll.

The opposing surface may advantageously be made using a flexible drive consisting for example of a belt or a plurality of parallel belts travelling around two pulleys. In this case the opposing surface is represented by the external surface of the lower half of the flexible drive. If the device has a reel supporting and conveying surface, it may extend approximately parallel to the lower half of the flexible drive, at a distance such that the reel can move between said surface and the lower half of the flexible drive, in contact with both these parts and with a possible slight pressure. In this case the flexible drive serves to roll the reel in a controlled manner along the supporting and conveying surface. As soon as the reel comes into contact with the unwinding roll in the unwinding position, the reel is found to be in contact with two points moving at equal speeds and in opposite directions, with the result that it is temporarily arrested in this position while continuing to rotate about its axis. The vacuum generated by the vacuum unit in the area adjacent to the reel detaches and unwinds the tail end. The subsequent slowing down or stopping of the unwinding roll causes the reel to advance again along the supporting and conveying surface, towards the dispenser and then towards the means which reclose the reel.

In another embodiment, the vacuum unit is provided with means for intercepting the vacuum, which interrupt it when the reel is transferred from the unwinding means to the glue dispenser. This prevents glue from accidentally getting into the vacuum space, especially during reel transfer.

In an especially advantageous embodiment of the device according to the invention, the conveying means comprise a transfer member that transfers the reel from the unwinding means to the dispenser. The means of interception are controlled by said transfer member, the movement of the transfer member determing the closing and opening of the means of interception. The transfer member is preferably pivoting. In one embodiment of the device, the unwinding means comprise a pair of unwinding rolls on which the reel is positioned. In this case the pivoting transfer member preferably pivots about the axis of one of said unwinding rolls, in order to take the reel from said unwinding rolls and roll it towards the dispenser.

Further advantageous features of the improved device according to the present invention are indicated in the accompanying claims and will be described in greater detail below.

BRIEF DESCRIPTION OF THE DRAWINGS

The invention will be understood more clearly from a perusal of the description and enclosed drawing, the latter showing a practical, non-limiting embodiment of the invention. In the drawing:

FIGS. 2 to 6 show successive stages in the working of the device shown in FIG. 1;

DETAILED DESCRIPTION OF THE INVENTION

Figure 1:
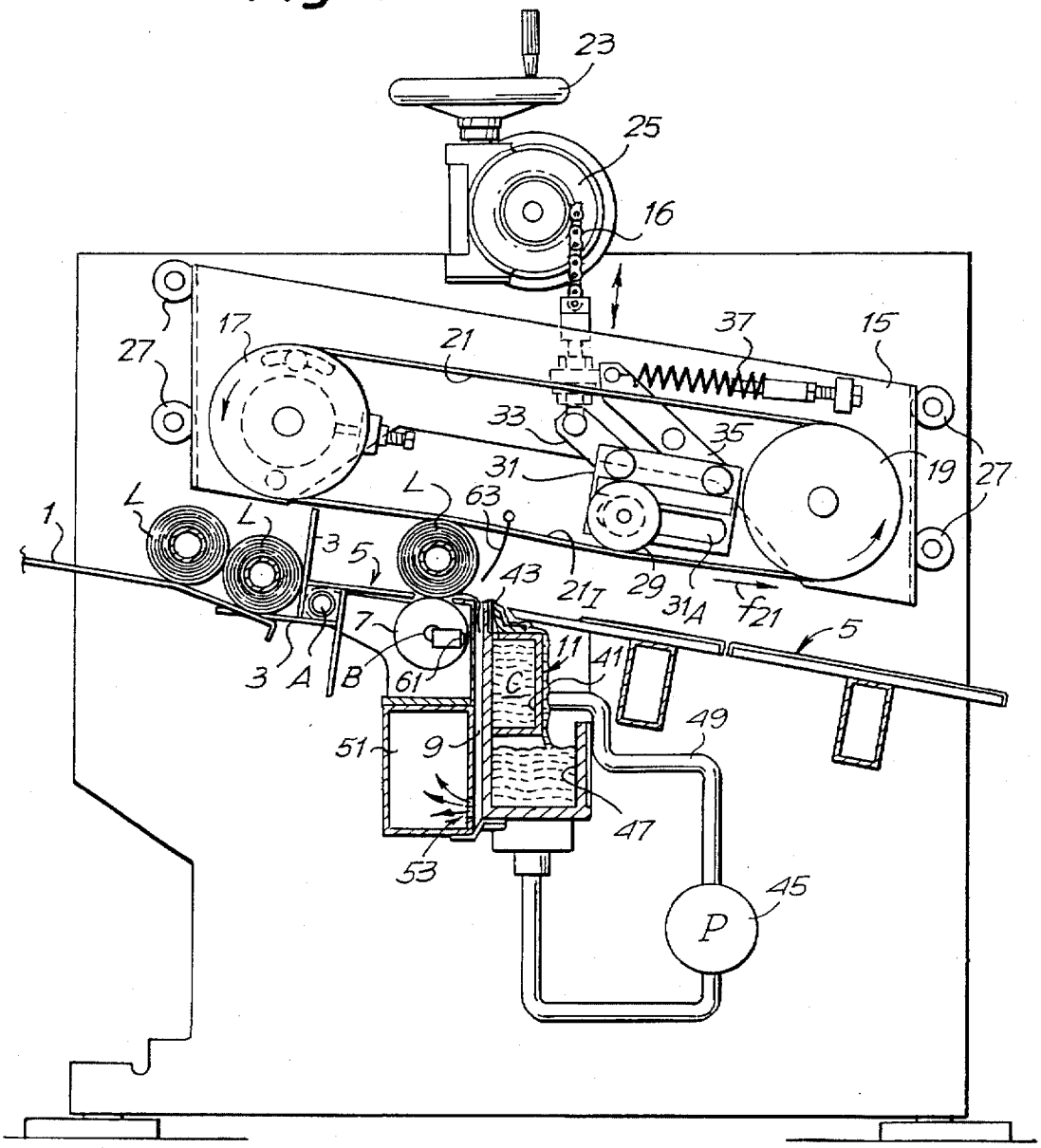
FIG. 1 shows a side view of the device according to the invention in a first embodiment.

In a first embodiment, illustrated in FIGS. 1 to 6, the device according to the invention comprises an entry chute 1, on which the reels L arrive in succession from a re-reeling machine positioned upstream of the device, and not shown. In the accompanying figures the reels L are of the type having a central winding core, but it is obvious that the working of the device of the present invention will not be changed if it is used for gluing reels that have no central winding core.

The numeral 3 indicates a feeder rotating about an axis A, which transfers one reel at a time from the chute 1 to a supporting and conveying surface indicated as a whole by the numeral 5. Downstream of the feeder 3, the surface 5 comprises an aperture from which the upper surface of an unwinding roll 7, rotating about a fixed axis marked B, projects slightly. Downstream of the unwinding roll 7 (which in the example illustrated rotates anticlockwise) is a vacuum space 9 leading down underneath the surface 5. Positioned downstream of the mouth of the space 9 is the glue dispenser, indicated 11 as a whole. The dispenser is positioned underneath a dispensing aperture 13 formed along the supporting and conveying surface 5. The latter then continues towards the reel discharge area where there are collecting means (not shown) which take the glued reels and transfer them to the cutting machine which cuts up the individual reels into a plurality of rolls of predetermined height.

Above the supporting and conveying surface 5 is an assembly 15 suspended by a chain 16 at a height that can be adjusted to suit the dimensions of the reels L for the purposes indicated below. The assembly 15 carries a pair of rolls 17, 19 around which a flexible drive 21, consisting of one or a series of belts or the like travels. The flexible drive 21 has a lower half 21I that runs approximately parallel with the reel supporting and conveying surface 5. The distance from the lower half 21I to the surface 5 is adjustable by means of a system comprising a handwheel 23 and a speed-reducing mechanism 25, by means of which the assembly 15 can be moved vertically, guided laterally by means of rolls 27 and tracks respectively. The handwheel 23 and the speed-reducing mechanism 25 may also be replaced by a geared-down motor or the like.

Between the upper and lower halves of the flexible drive 21 is a pressure roll 29 mounted on a unit 31 which in turn is supported by links 33, 35 connected to a spring-loaded member 37 which pushes the pressure roll 29 down against the lower half 21I of the flexible drive 21. The unit 31 has a slot 31A along which the pressure roll 29 can be positioned in order to alter its position relative to the glue dispenser 11 for the purposes described below.

The dispenser 11 is, in the example in FIGS. 1 to 6, an up-welling dispenser of the kind disclosed in for example U.S. Pat. No. 5,259,910, the contents of which are incorporated in the present description. In the present document, a brief account of only the essential parts of the dispenser 11 will be given. The dispenser 11 comprises a container 41 of glue with an upper aperture 43 approximately flush with or slightly projecting from the supporting and conveying surface 5. The glue C contained in the container 41 is under slight pressure and therefore continuously—or more or less continuously—emerges through the upper aperture 43. The numeral 45 indicates a recycling pump which takes the glue from an overflow tank 47 and injects it under slight pressure through a pipe 49 into the container 41. The glue dispensed through the aperture 43 and not picked up by the reel is collected in the tank 47 and recycled.

Communicating with the vacuum space 9 is a vacuum box 51 connected to a vacuum line (not shown). The vacuum box 51 extends across approximately the entire width of the device, at right angles to the plane of the figures, and has an opening or a plurality of openings 53 permitting communication between the box 51 and the vacuum space 9. The openings 53 are located in the lower part of the vacuum space 9.

Figure 2:
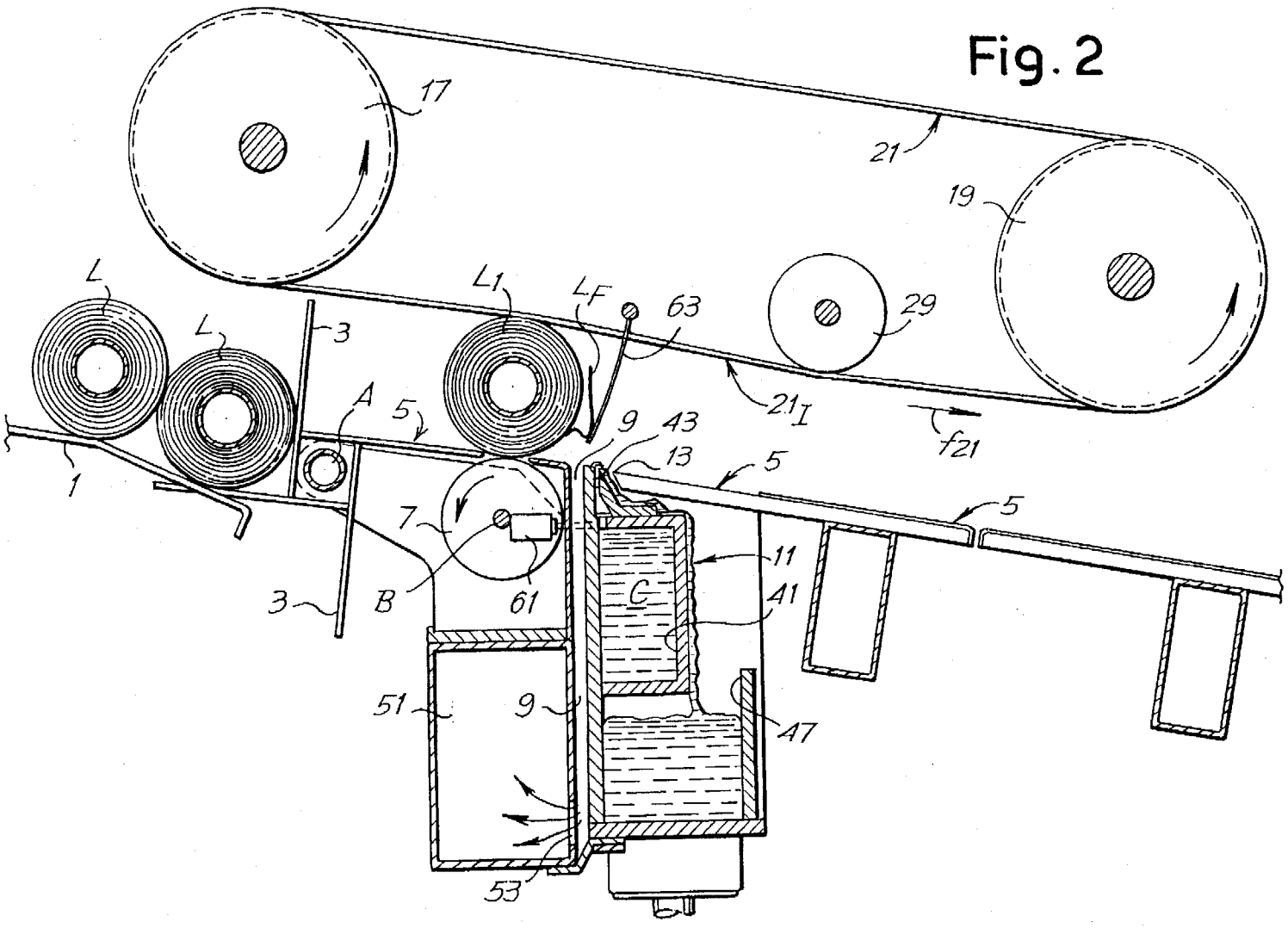

The device described hitherto operates in the following manner. Each individual reel L is taken from the chute 1 by the rotating feeder 3 and unloaded onto the supporting and conveying surface 5. The rotation of the feeder 3 about its axis A forces the reel between the supporting and conveying surface 5 and the lower half 21I of the flexible drive 21. Said flexible drive is driven in the direction shown by the arrow f21 by one of the pulleys 17, 19, which for this purpose is powered in some way. Thus the reel L is rolled in a controlled manner along the first portion of the supporting and conveying surface 5. It should be noted that said first portion of the surface 5 is of comb construction in order that the feeder 3 can revolve. After rolling a certain distance over the surface 5, the reel L comes into contact with the upper portion of the unwinding roll 7, which projects from the surface 5. This is shown in FIG. 2 where the reel in contact with unwinding roll 7 is marked L1. When the reel reaches position L1, it begins to rotate about its axis, clockwise in the drawing, while remaining in position L1. Meanwhile the vacuum space 9 is in depression because of the suction exerted by the vacuum box 51. Consequently, when the tail end LF appears on the right hand side (in FIG. 2) of the reel L1, it is detached from the external surface of the reel L1, unwound from it and sucked into the vacuum space 9. FIG. 2 shows the tail end LF as it first comes away from the external surface of the reel L1 while FIG. 3 shows the position assumed by the tail end LF once sucked into the vacuum space 9. The roll 7 continues to rotate even when the tail end LF is inside the vacuum space 9 and therefore said end is gradually drawn out and rewound onto the reel L1 until the terminal edge of the tail end LF is in front of a sensor, which may be optical or the like, 61. The position of the sensor 61 can be adjusted to alter the length of tail end unwound. Alternatively (or in combination), the adjustment of the length of the tail end can be brought about by appropriately delaying the stopping of the rotating of the roll 7 relative to the signal from the sensor 61. This sensor, when it detects the position of the tail end, stops the roll 7 from rotating, thereby causing the reel to advance in a controlled manner towards position L2 shown in FIG. 4. In position L2 the reel is rotating on the surface 5 over the aperture 43 of the dispenser 11. In this way the glue is applied to the reel in the location uncovered by the partial unwinding of the tail end LF.

Figure 5:
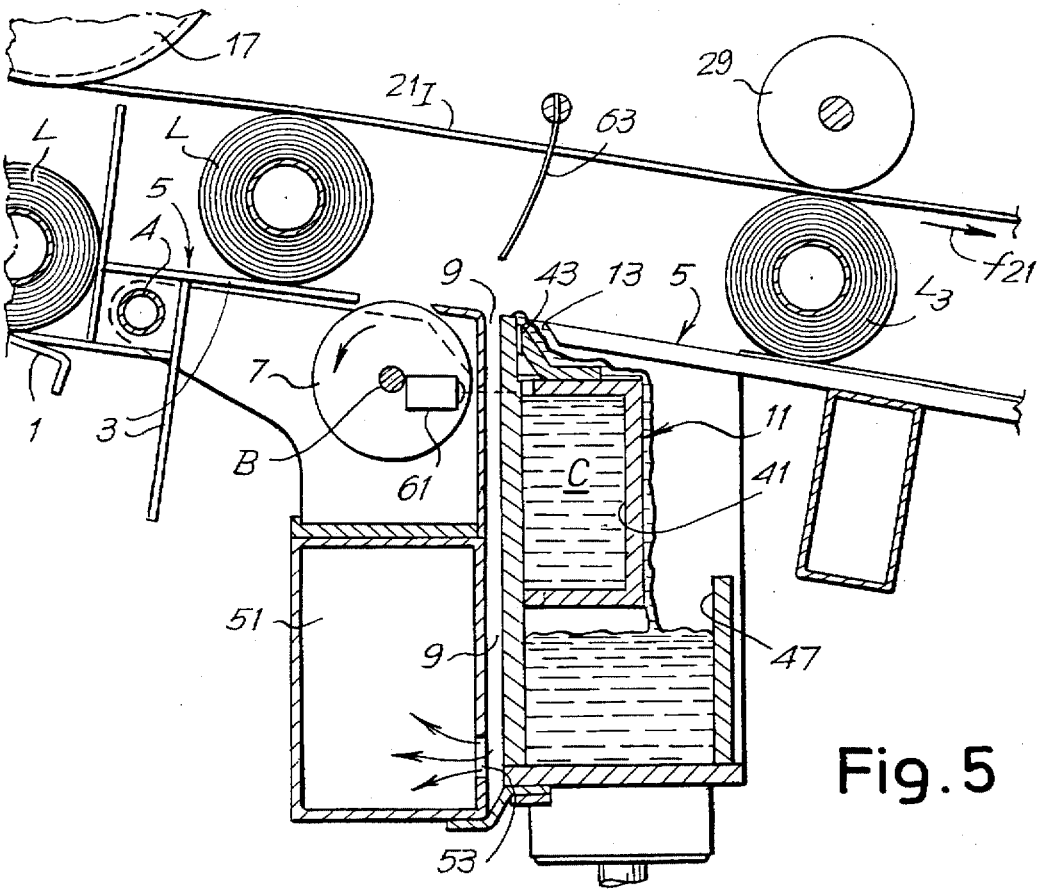

As the translation movement of the lower half 21I of the flexible drive 21 is continued, the reel is caused to roll in a controlled manner along the supporting and conveying surface 5 from position L2 in FIG. 4 to position L3 in FIG. 5, where the reel is underneath the pressure roll 29, which presses on the surface of the reel at the point where the tail end is to be stuck. The position of the pressure roll 29 is adjusted so as to act on the reel at the point where the glue has been applied, in order to guarantee a better closure without it being necessary to hold the reel in position L3, causing it to execute a complete revolution in this location.

Figure 6:
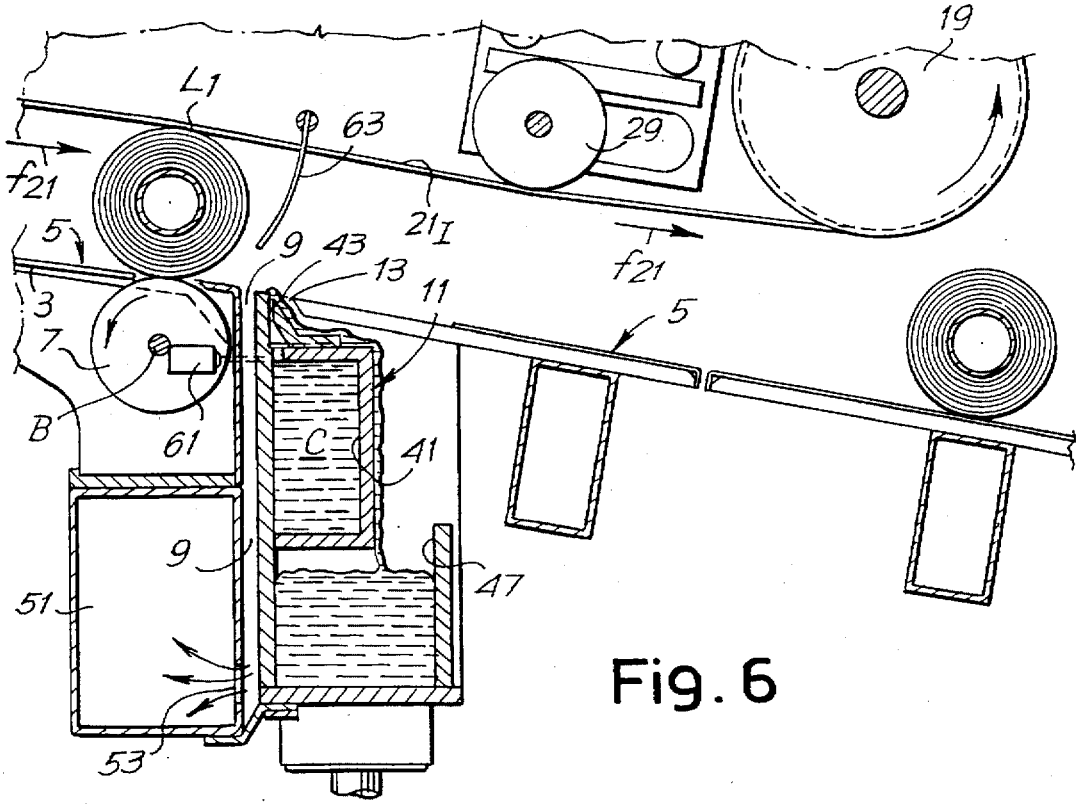

FIG. 6 shows the next step, with the now glued reel in the discharging area and a new reel in position L1 for its free end to be opened.

As can be seen in particular in FIG. 2, the tail end LF sucked into the vacuum space 9 may theoretically open and then accidentally touch the dispensing opening 43 of the dispenser 11 and so be soiled with glue on the outside. In order to avoid such an occurrence, in the embodiment shown in FIGS. 1 to 6 an easily deformable resilient blade 63 is provided, which in the position of FIG. 2 prevents the tail end LF from brushing over the dispensing aperture 43 as it is opened, but easily allows the reel pushed by the flexible drive 21 to pass it as it rolls along the surface 5.

Figure 7:
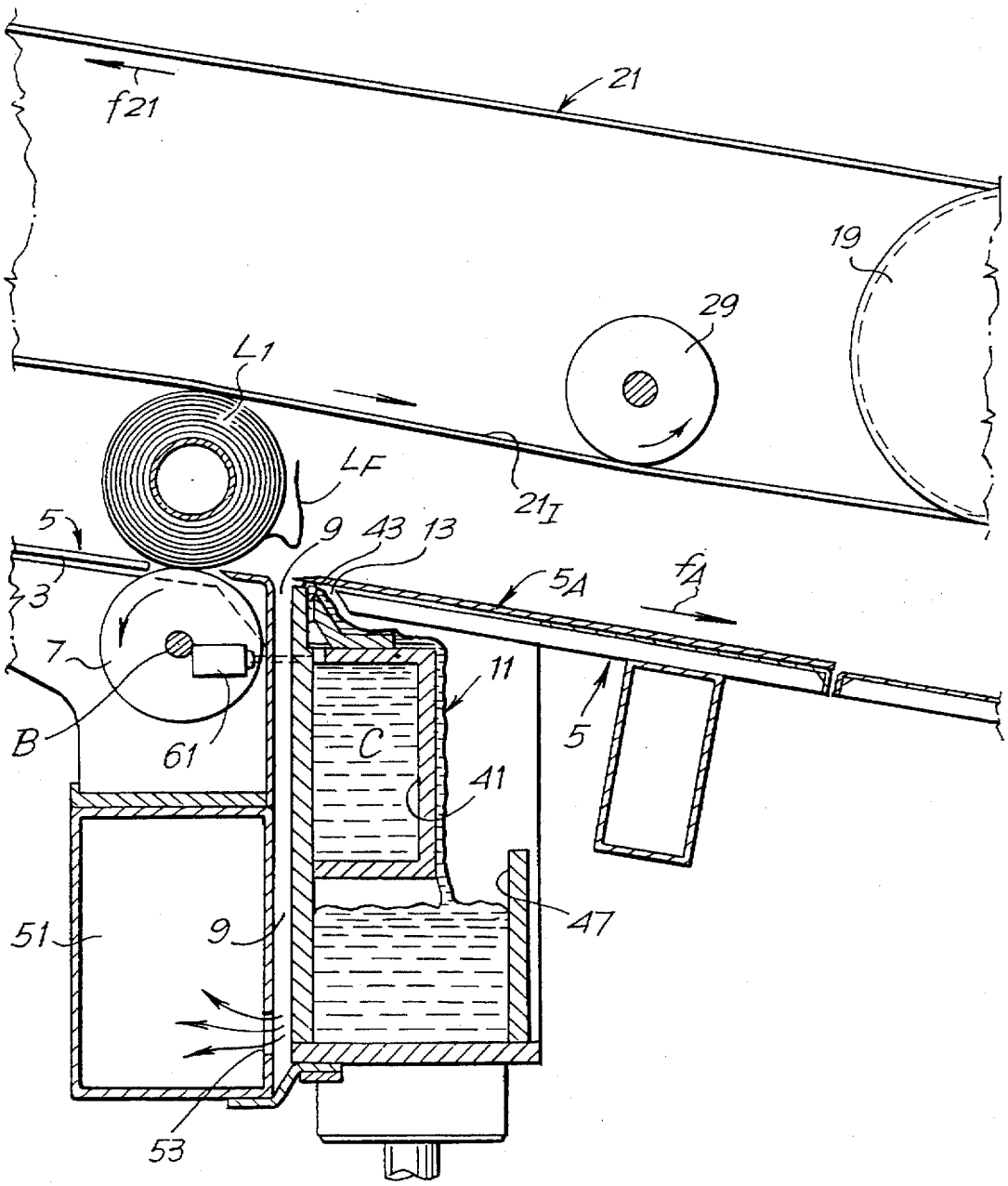
FIG. 7 shows a longitudinal section of an improved embodiment of the device shown in FIG. 1.

Instead of a resilient blade 63, it is possible to use a system for covering the aperture 43 for example as shown diagrammatically in FIG. 7, where identical parts are identified by the same reference numerals as those in FIGS. 1 to 6. In this case a portion of the surface 5 is formed by a movable plate 5A which can adopt a closed position, illustrated in FIG. 7, in which this plate lies over the glue dispensing aperture 43, until the tail end LF has been sucked into the space 9. The plate 5A can then be withdrawn (by a suitable actuator, not shown) in the direction of the arrow fA shown in FIG. 7, so as to uncover the glue dispensing aperture and therefore allow the glue to be applied to the reel as the latter rolls over it towards the exit.

Figure 8:
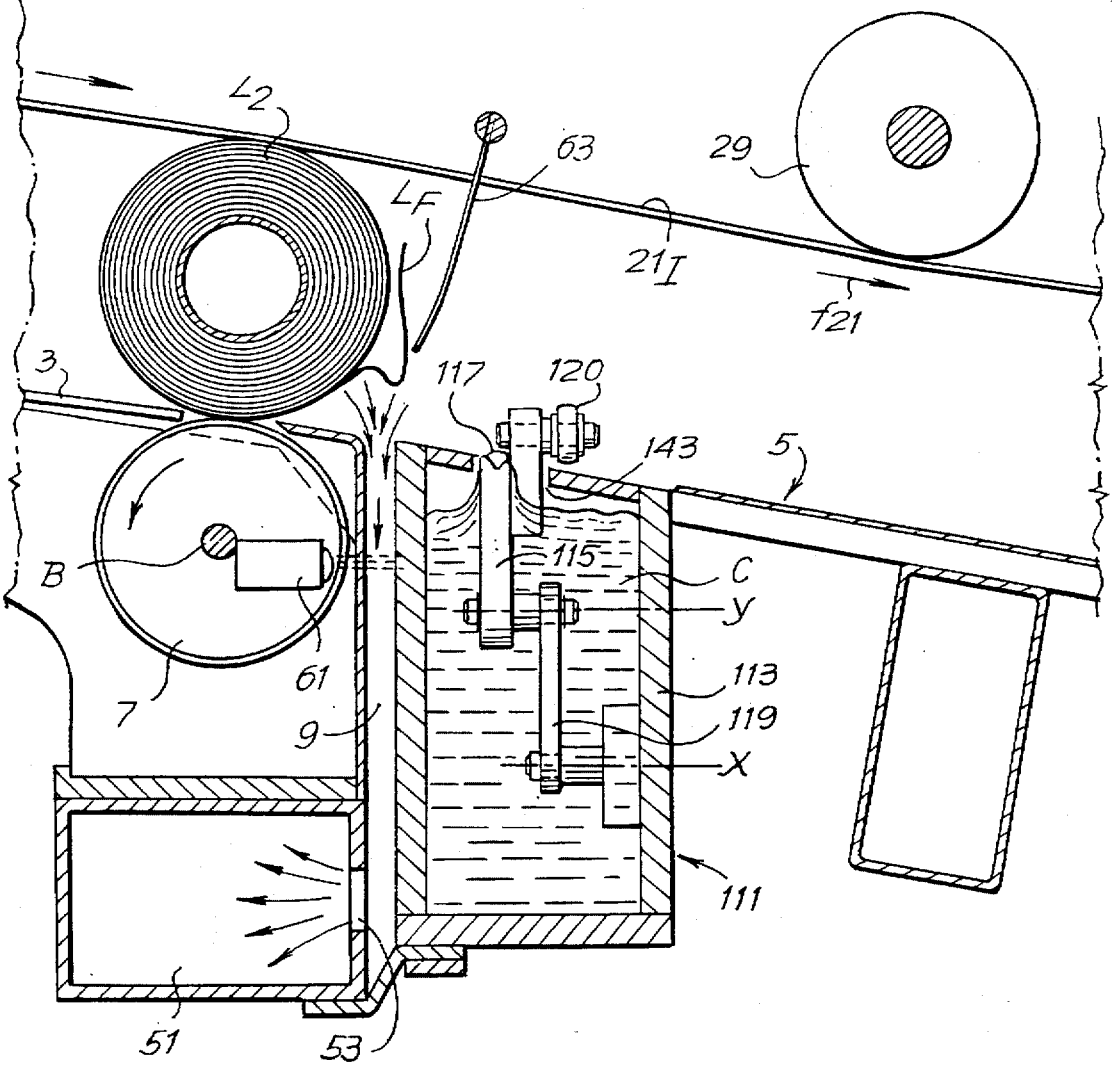
FIG. 8 shows the device according to the invention with a different type of glue dispenser.

It should be understood that the devices which enable the detachment and partial unwinding of the tail end of the reel by suction or depression can be used with slightly different gluing devices. FIG. 8 diagrammatically shows the same unwinding device connected to a glue dispenser, marked 111 as a whole, having some minor constructional differences. Stated briefly, the dispenser 111 comprises a container 113 containing the glue C. Inside the container 113 is a moving member 115 consisting of a transverse bar with a concave upper surface 117. The moving member 115 is mounted on at least two rockers 119 (only one of which is visible in FIG. 8), each hinged about a spindle X integral with the container 113 and about a spindle Y integral with the moving member 115. The numeral 120 indicates a joint connecting the moving member 115 to a cylinder-piston actuator or the like which generates a pivoting movement in the rockers 119 about the spindle X and consequently a translational movement of the moving member 115, which adopts alternately an upper position, shown in FIG. 8 and a lower position, in which the concave surface 117 is below the level of the glue C. In the upper position the concave surface 117 is at a level such that the fraction of glue collected in said concave surface is approximately level with the surface 5 in a dispensing aperture 143. The reel L is rolled along the surface 5 over the dispensing aperture 143 when the moving member 115 is in its raised position. After each reel has passed, the moving member 115 is lowered in order to collect a fresh load of glue C for application to the next reel. By giving the concave surface 117 appropriate dimensions, it is possible to alter the quantity of glue available at any particular time.

The dispenser shown in FIG. 8 has the advantage that it can withdraw the moving member 115 from the supporting and conveying surface 5 during the unwinding of the tail end LF of the reel. Thus, although in FIG. 8 the tail end is shown in the initial stage of detachment from the external surface of the reel L, and the moving member 115 is shown in its raised position, it is possible to delay the lifting of the moving member 115 until the tail end LF has been fully sucked into the vaccum space 9. By this means it is possible to dispense with the blade 63 or any other system of covering the dispensing aperture 143 during the unwinding of the tail end LF.

FIGS. 9 to 14 show an improved embodiment of the device according to the invention. In this embodiment, the device comprises a chute 201 on which the reels L arrive in succession from the re-reeling machine (not shown). The numeral 203 indicates a feeder rotating about an axis A, which transfers one reel at a time from the chute 201 to an unwinding section, denoted 205 as a whole. The station 205 has a pair of unwinding rolls 206 and 207, which in the embodiment illustrated are of two different diameters. With the two rolls 206, 207 is a pivoting transfer member 208 hinged about the axis 207A of the unwinding roll 207. The pivoting transfer member 208 is controlled by a cylinder-piston actuator 210.

Downstream of the unwinding station 205 is a vacuum space 209 whose mouth is directly downstream of the roll 207.

Positioned downstream of the mouth of the vacuum space 209 is a glue dispenser, indicated as a whole by the numeral 211, following which is a rolling surface 214 along which the glued reel rolls before emerging from the gluing device.

Above the glue dispenser 211 and above the rolling surface 214 is a pivoting assembly 215 comprising an L-shaped arm 216 whose pivot is at 216A. The arm 216 carries a roll 217 positioned approximately over another roll 218 which projects slightly from the rolling surface 214 for the purposes specified below. The distance between the rolls 217 and 218 can be adjusted by means of a handwheel 223 and an elastic system 225.

In the example shown, the dispenser 211 is an up-welling-type dispenser, with a dispensing slot 243, of the type described with reference to FIGS. 1 to 6 discussed above.

Communicating with the vacuum space 209 is a vacuum box 251 connected to vacuum line (not shown). The vacuum box 251 extends across approximately the entire width of the device, at right angles to the plane of the figures, and has an opening or a plurality of openings 253 permitting communication with the vacuum space 209.

Located inside the vacuum space 209 is a closure valve 261 hinged about an axis 264, and whose own weight, together with the depression inside the chamber 251, and optionally an elastic means (not shown), tend to move it into the position of interception. It is held in the open position by one or more rods 263 mounted on an arm 208A of the pivoting transfer member 208. The position of the valve 261 depends, therefore, on the angular position of said pivoting transfer member 208.

Figure 11:
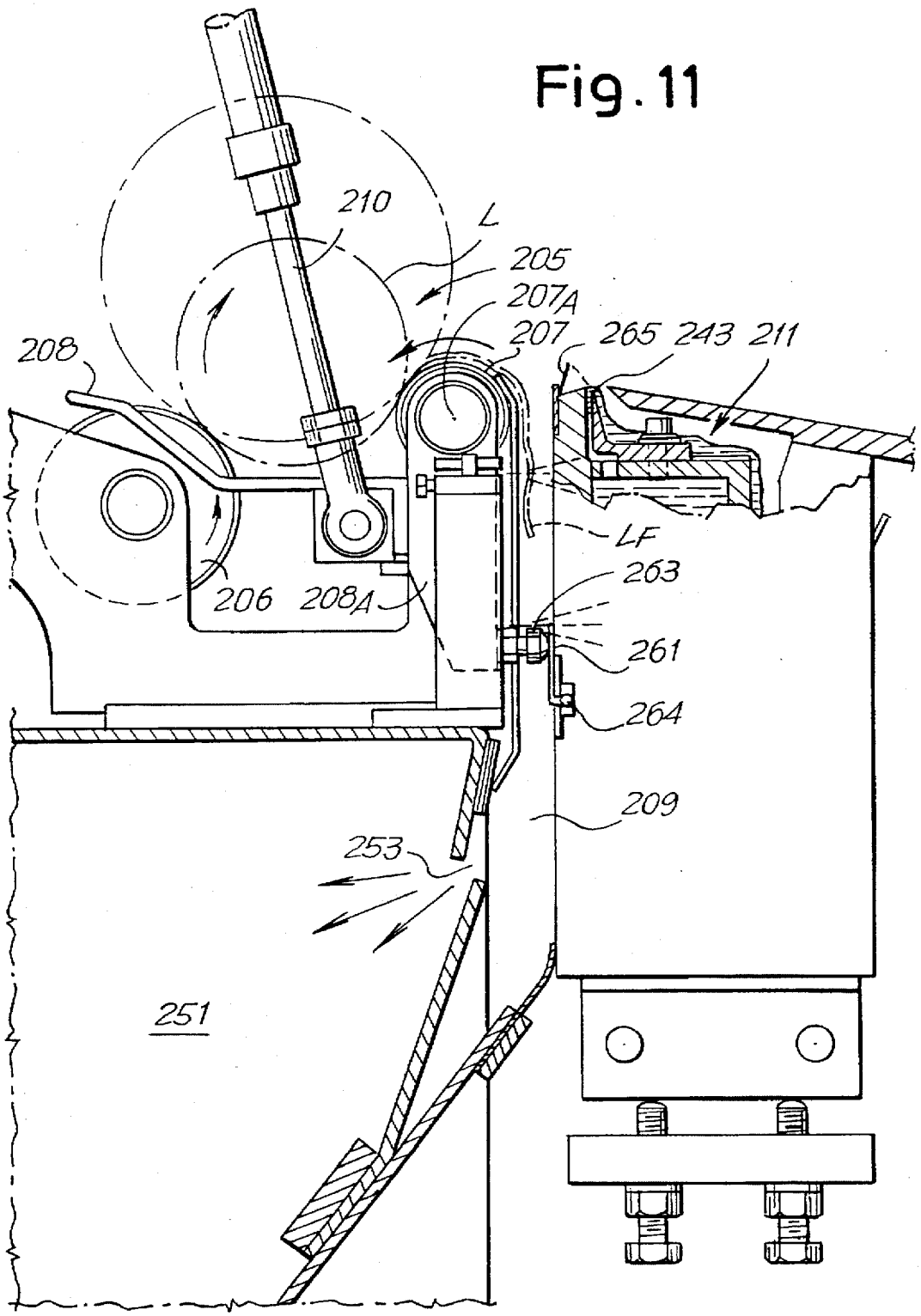
FIGS. 11 to 14 show, in an enlarged detail, successive stages in the working of the device shown in FIG. 9.
Figure 12:
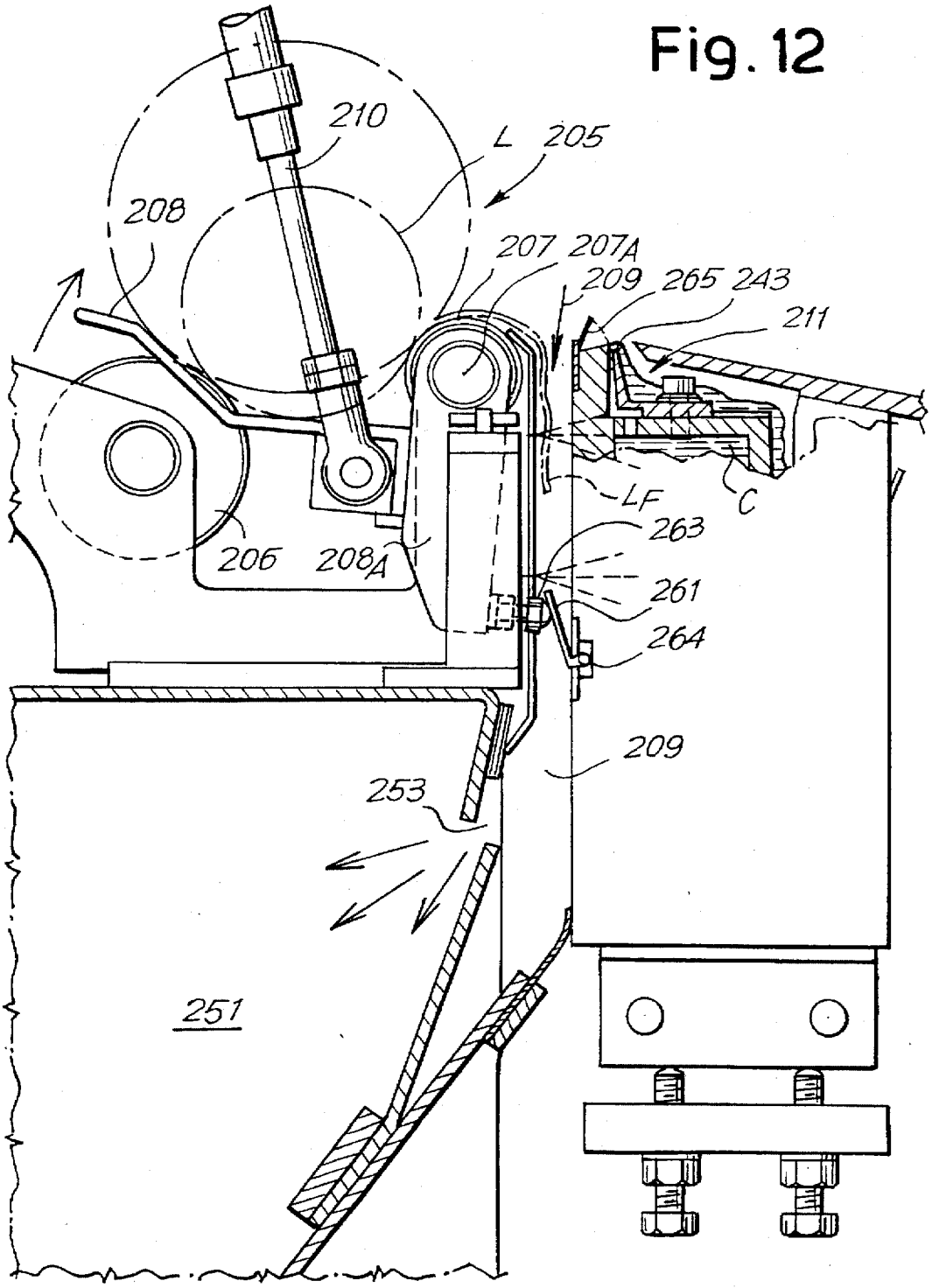
Figure 13:
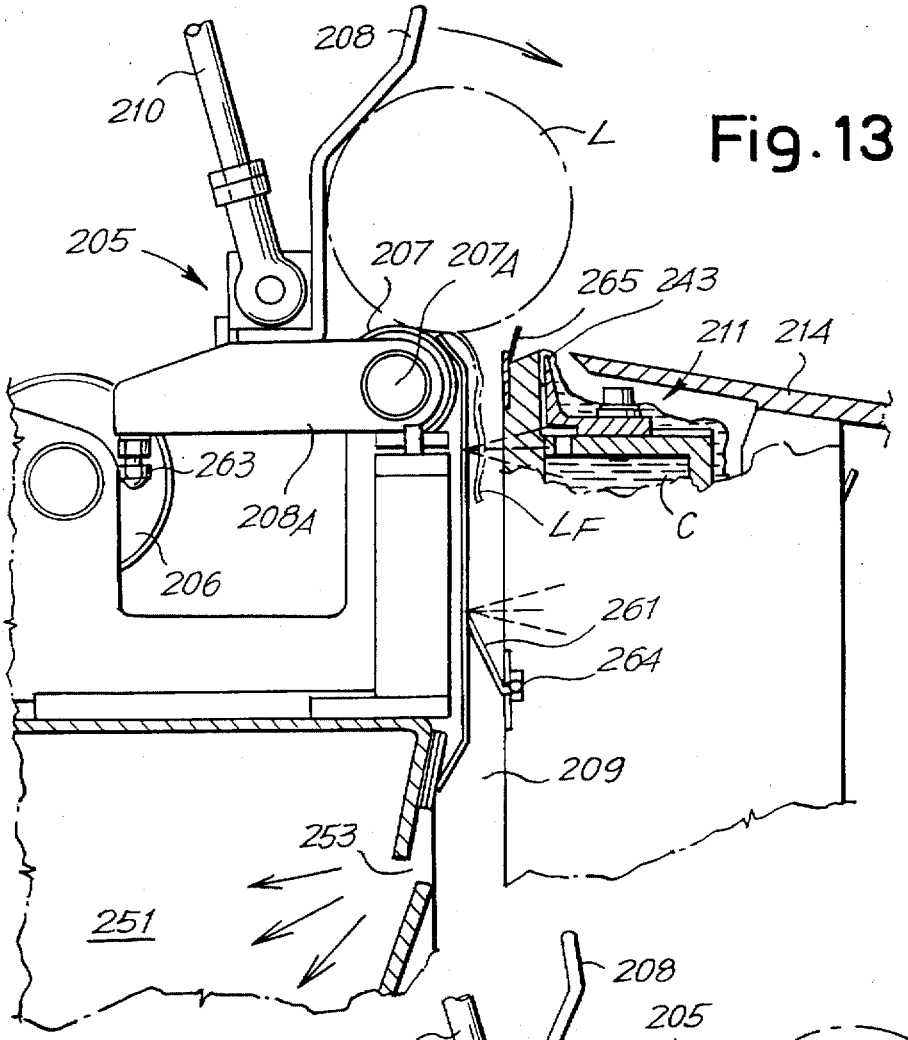

Between the dispensing slit 243 of the dispenser 211 and the mouth of the vacuum space 209 is a tongue 265 made of an elastic material such as rubber or plastic, which when unstressed assumes the approximately vertical position shown in FIGS. 11 to 13.

Figure 9:
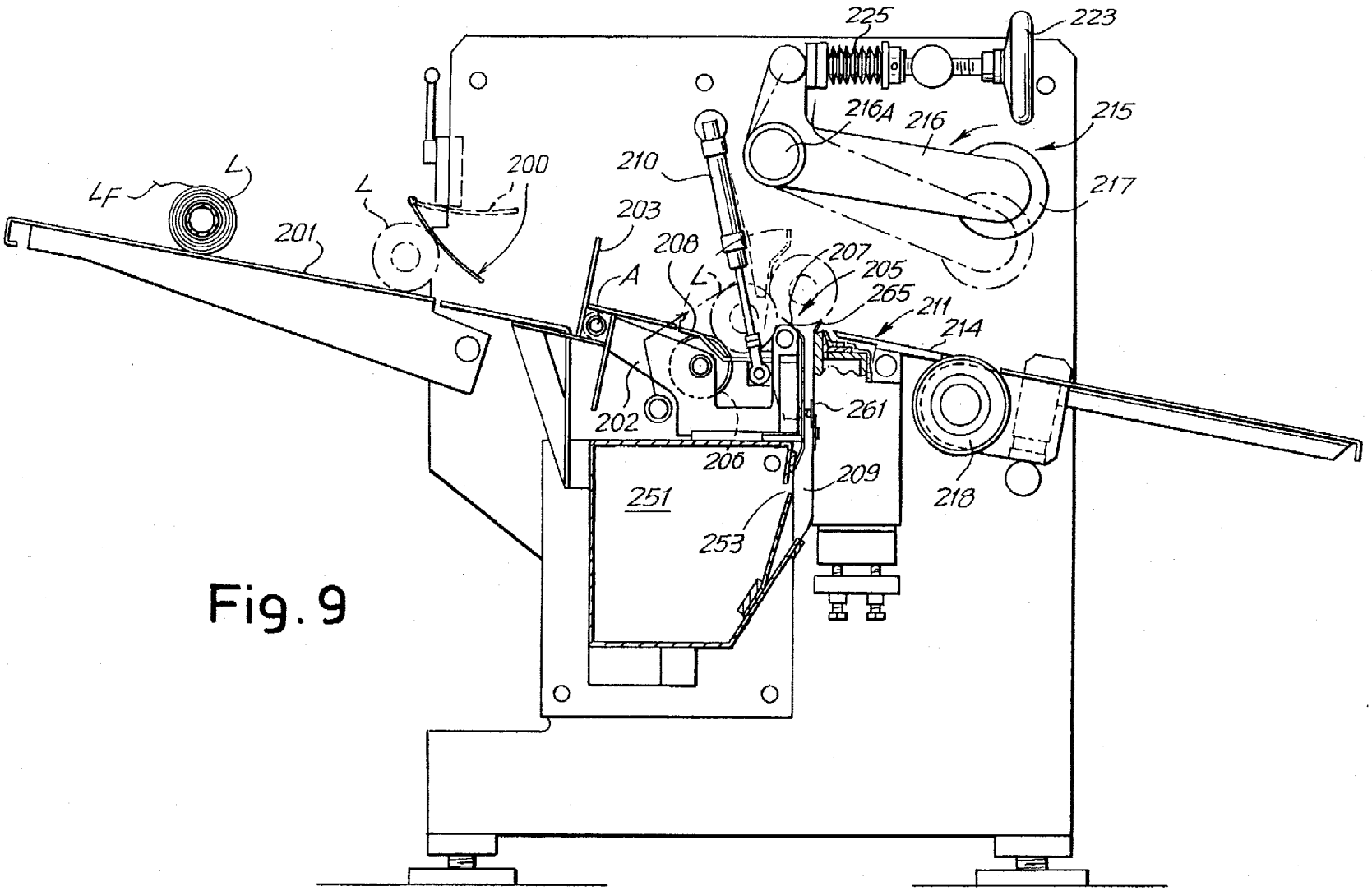
FIG. 9 shows a side view of the improved device.

The device described thus far works in the following manner. The reels come from an upstreamre-reeling machine (not shown) and roll along the chute 201. A spring-loaded flap 200 ensures that the reels L do not arrive with excessive speed on the rotating feeder 203. Each individual reel L is taken from the chute 201 by the rotating feeder 203 and unloaded onto the two unwinding rolls 206, 207, while the pivoting transfer member 208 is in the lowered position (FIGS. 9 and 11). When the reel L is on the unwinding rolls 206 and 207, these rotate anticlockwise and also cause the reel L to rotate about its own axis in the clockwise direction. The rotating of the unwinding rolls 206, 207 may begin immediately before or immediately after the arrival of the reel L. In this position the vacuum space 209 is at low pressure. Consequently, when the tail end LF is to the right (FIGS. 9 and 11) of the reel L, it is detached from the external surface of the reel, unwound from it and sucked into the vaccum space 209. The unwinding of the tail end LF is facilitated by the presence of a system of air nozzles 202 (see in particular FIGS. 9 and 10), which lift the tail end LF from the reel as it rotates on the unwinding rolls 206 and 207. This leads to faster insertion of the end LF into the vacuum space 209. Moreover, by using the nozzle 202 system, it is possible to unwind a greater length of web material, thereby making it possible to achieve greater and easier adjustments when the tail end LF is being positioned for gluing.

Figure 10:
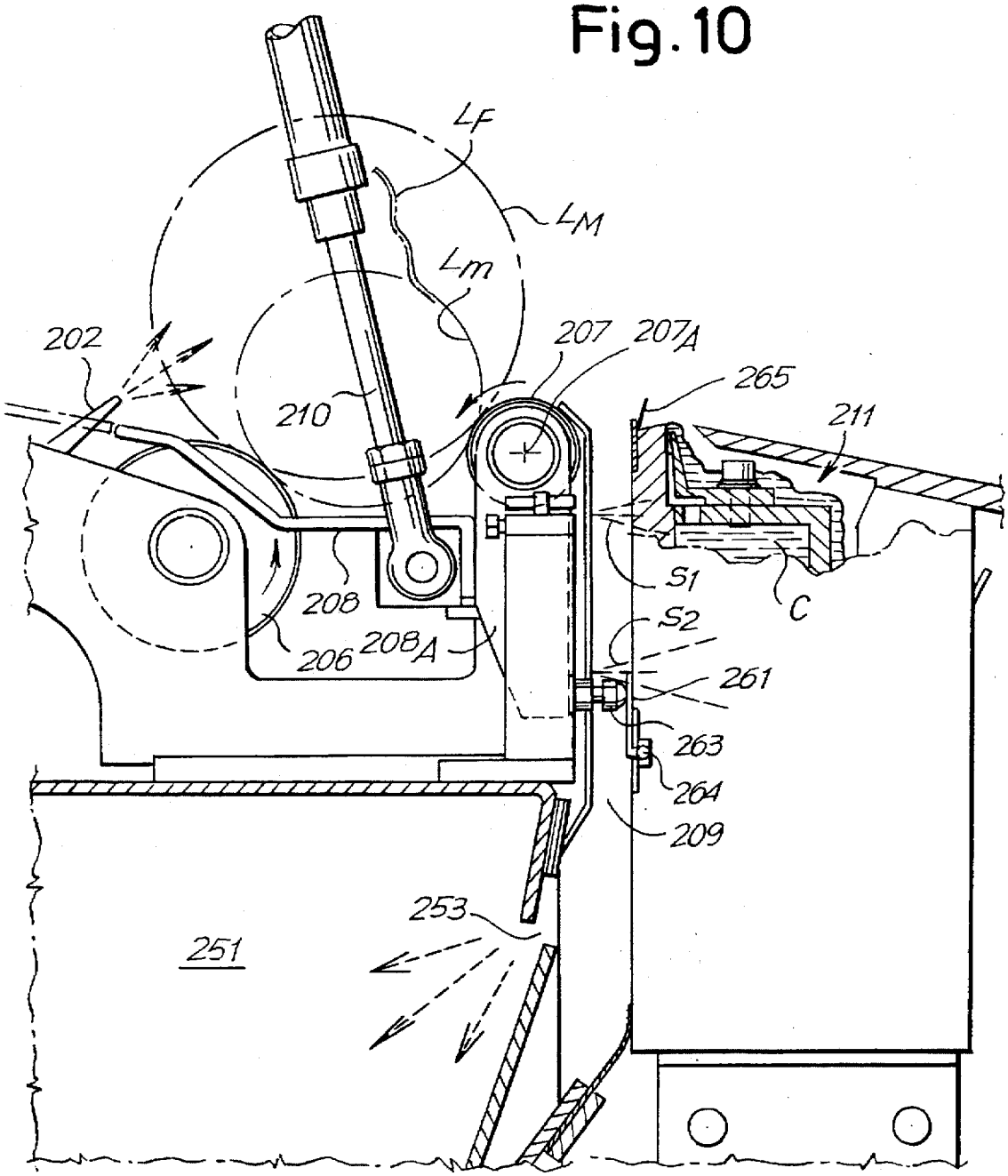
FIG. 10 shows an enlargement of FIG. 9.

The rotation of the unwinding rolls 206, 207 still continues when the tail end LF is inside the vacuum space 209, and consequently said end is gradually withdrawn and rewound onto the reel L until the terminal edge of the free end is in front of an optical or suchlike sensor, which stops the unwinding rolls 206, 207 from turning. The position of the sensor may be adjustable and/or the stopping of the rolls 206, 207 may be delayed by an adjustable length of time in order to obtain the desired length of unwound tail end LF. In FIG. 10, S1 and S2 show the extreme positions which the sensor may assume.

Figure 14:
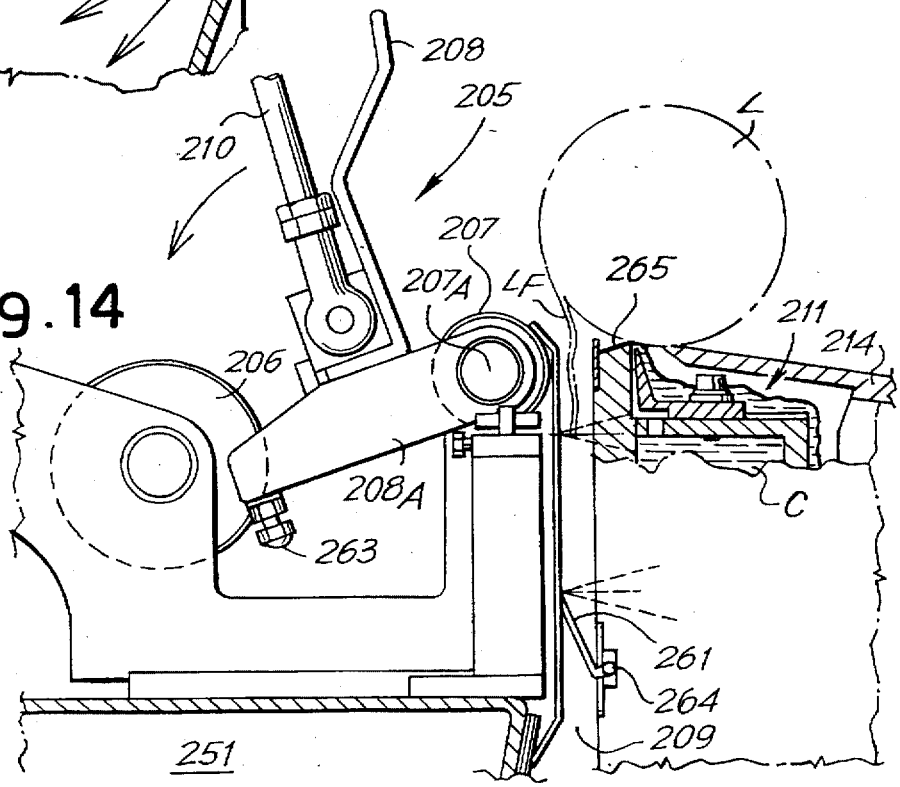

At this point the pivoting transfer member 208 is turned clockwise about the axis 207A in order gradually to transfer the reel L over the dispensing slit 243 of the glue dispenser 211. FIGS. 12 to 14 show successive stages of the transfer of the reel, which rolls on the surface of the roll 207 and hence over the dispensing slot 243 and eventually reaches the rolling surface 214. As FIG. 10 clearly shows, the pivoting transfer member 208 is of such a shape as to be able to accommodate and transfer reels of highly variable diameters. In FIG. 10, the references Lm and LM show the minimum and maximum diameters of the reel.

The transfer of the reel from the unwinding rolls 206, 207 to the parts downstream could take place even without the transfer member 208, by for example mounting the unwinding roll 206 on a pivoting arm hinged about the axis of the unwinding roll 207. The rods 263 could in this case be integral with said pivoting arm.

During the clockwise pivoting movement of the transfer member 208, the rod 263, in withdrawing from the vacuum space 209, allows the valve 261 to close this space and intercept the vacuum. In this way the flow of air in through the mouth of the space 209 is stopped. This prevents glue from being sucked in accidentally from the area around the dispensing slit 243, especially when the reel L begins to close the mouth of the space 209. Under these conditions, if the flow of air were not intercepted by the valve 261 or the vacuum not interrupted glue might enter the space 209 because of the high speed of the air around the mouth of the vacuum space that is partly closed by the reel L.

As is clearly visible in FIG. 14, the reel L rolls over the elastic flap 265, which bends to enable the reel to pass it as it moves towards the dispenser. In its extended position the flap 265 prevents the possible accidental ingress of glue into the vacuum space 209 when the latter is not closed by the valve 261. This makes it absolutely certain that there can be no ingress of glue into the vacuum space 209 even without cyclically interrupting the vacuum in the box 251, which would mean having to reduce the speed of the machine owing to the inertia due to the large volume of the chamber 251.

Transferring the reel through the machine is very simple and easy to accomplish, inasmuch as the path of the reel is entirely downhill, and so the movement of the reel is facilitated by the force of gravity.

The elastic flap 265 could also be replaced by a metal blade fitted with suitable elastic means, such as a spring.

When the reel reaches the rolling surface 214, it begins to roll towards the exit and passes between the rolls 217, 218, at least one of which, (preferably the roll on the fixed axis 218) is a drive roll. The pressure exerted by the upper roll 217 ensures the adhesion of the free tail end to the reel on which the glue has been applied by the dispenser 211.

The transfer member 208, the valve 261 and the flap 265 here described could also be used separately from each other and/or in one of the embodiments described with reference to FIGS. 1 to 8.

It will be understood that the drawing shows only an illustrative embodiment provided purely by way of a practical demonstration of the invention, it being possible to vary said invention as regards shapes and arrangements, yet without departing from the scope of the concept underlying the invention. Any reference numerals in the accompanying claims are purely for facilitating the reading of the claims with reference to the description and to the drawing, and do not limit the scope of protection represented by the claims.

I claim:

1. A device for gluing a tail end of a reel of wound web material comprising: conveying means for moving the reel along a path in a conveying direction; unwinding and positioning means for unwinding and positioning the tail end of the web material; a dispenser of glue for applying glue to a portion of the web material; and means for rewinding the tail end after the glue has been applied; wherein said unwinding and positioning means comprise a vacuum space leading down underneath the path of the reel which generates a vacuum around the reel and serves to detach and unwind the tail end of the web material from the reel, as well as position the tail end before the glue is applied to the wound web material on said reel by means of the glue dispenser.

2. A device according to claim 1 wherein the tail end of the reel is sucked into said vacuum space.

3. A device according to claim 1 including detecting means for detecting the length of the tail end unwound from said reel.

4. A device according to claim 3 wherein said detecting means comprise a sensor positioned inside said vacuum space.

5. A device according to claim 3 wherein said detecting means are adjustable in order to control what length of tail end is to be unwound.

6. A device according to claim 2 wherein the glue dispenser is positioned adjacent to said vacuum space and downstream of the vacuum space with respect to the conveying direction of the reel.

7. A device according to claim 1 wherein the unwinding and positioning means also comprise: reel retaining means that keep the reel in the unwinding position which includes at least one roll which, by rotating, causes the reel to rotate about its own axis.

8. A device according to claim 7 including, above said at least one roll, a movable opposing surface positioned at a distance from the at least one roll such that the reel is stopped between said at least one roll and said opposing surface, said opposing surface being able to adopt, at the point of contact with the reel, a speed equal and opposite to the peripheral speed of the at least one roll at the point of contact between the at least one roll and the reel.

9. A device according to claim 8 wherein said opposing surface is formed by a portion of a flexible drive traveling around end rolls.

10. A device according to claim 1 further including: a reel supporting and conveying surface having an aperture in said surface downstream of said unwinding and positioning means through which the glue is dispensed, said glue dispenser being positioned in relation to said aperture so as to dispense glue through said aperture onto said wound web material; and, running above and approximately parallel with said supporting and conveying surface, a flexible drive traveling between two end rolls, a lower half of said flexible drive being positioned at a distance from the reel supporting and conveying surface approximately equal to a diameter of the reel.

11. A device according to claim 10 wherein downstream of the glue dispenser with respect to the conveying direction of the reel, is a pressure roll positioned above the lower half of the flexible drive, in order to compress the reel after the glue has been applied to the wound web material and the tail end reclosed onto the wound web material.

12. A device according to claim 10 wherein said flexible drive and said rolls are carried by a movable assembly for adjusting the distance between the flexible drive and the reel supporting and conveying surface beneath the flexible drive.

13. A device according to claim 11 wherein said pressure roll is carried by a unit whose position can be adjusted in order to modify the position of said pressure roll with respect to the glue dispenser.

14. A device according to claim 1, including a movable projection for retaining the tail end of the reel during unwinding.

15. A device according to claim 1 including covering means that cover the glue dispenser during unwinding of the tail end of the reel.

16. A device according to claim 1 wherein said glue dispenser comprises a container of glue with an upper aperture from which said glue is dispensed.

17. A device according to claim 1 wherein said glue dispenser comprises a container for the glue with an upper aperture and a moving member positioned inside said container, said moving member being constructed and arranged to be movable between being immersed in the glue contained in the container and being positioned in relation to said upper aperture so as to dispense the glue to the reel as the reel passes over the upper aperture.

18. A device according to claim 1 further comprising means for interrupting the vacuum when the reel is conveyed from the unwinding and positioning means to the glue dispenser.

19. A device according to claim 1 wherein said conveying means comprise a transfer member that transfers the reel from the unwinding and positioning means to the glue dispenser which operates in conjunction with a means of interruption of the vacuum so that movement of the transfer member determines closing and opening of the means of interruption.

20. A device according to claim 19 wherein said transfer member is a pivoting transfer member.

21. A device according to claim 20 wherein said unwinding and positioning means comprise a pair of unwinding rolls on which the reel is positioned, and said pivoting transfer member pivots about the axis of one of said unwinding rolls in order to take the reel from said unwinding rolls and roll the reel towards the glue dispenser.

22. A device according to claim 1 further comprising a means to interrupt said vacuum which includes a valve with a pivoting interrupting member held in an open position by one or more rods connected to a transfer member which transfers the reel from the unwinding and positioning means the glue dispenser.

23. A device according to claim 2 wherein between said glue dispenser and said vacuum space is present a deformable barrier that prevents the glue from being sucked into said vacuum space, said deformable barrier being lowered during transfer of the reel towards said glue dispenser.

24. A device according to claim 23 wherein said deformable barrier is a strip of plastic, rubber or equivalent material.

25. A device according to claim 1 including blowing means for facilitating initial unwinding of the tail end of the web material.

26. A device according to claim 1 wherein said unwinding and positioning means comprise a pair of unwinding rolls, and wherein one of said unwinding rolls can pivot about the axis of rotation of the other of said unwinding rolls in order to transfer the reel towards said glue dispenser.

27. A method for gluing a tail end of wound web material to form a reel, in which the tail end is detached from the reel and unwound from the reel to a predetermined length; glue is applied to a portion of the wound web material in order to glue the tail end to the wound web material of the reel; and the tail end is rewound onto the reel, wherein the tail end is detached and unwound from the reel by the generation of a vacuum in an area around the reel.

28. A method according to claim 27 wherein the glue is applied to a portion of web material still wound on the reel, and the tail end is placed back over said portion in the course of rewinding.

29. A device for gluing a tail end of a reel of wound web material comprising: conveying means for moving the reel along a path in a conveying direction; unwinding and positioning means for unwinding and positioning the tail end of the web material; a dispenser of glue for applying glue to a portion of the web material still wound on the reel; and means for rewinding the tail end after the glue has been applied on the reel, wherein said unwinding and positioning means comprise a vacuum space extending downwards from a reel conveying surface, said vacuum space providing a vacuum around the reel which serves to detach and unwind the tail end of the web material from the reel, and the unwinding and positioning means partially drawing said tail end out of said vacuum space for positioning the tail end before applying glue to said reel by means of the glue dispenser.

30. A device for gluing a tail end of a reel of wound web material comprising: conveying means for moving the reel along a path in a conveying direction; unwinding and positioning means for unwinding and positioning the tail end of the web material; a dispenser of glue for applying glue to a portion of the web material still wound on the reel; and means for rewinding the tail end after the glue has been applied on the reel, wherein said unwinding and positioning means comprise a vacuum space extending downwards from a reel conveying surface, said vacuum space providing a vacuum around the reel which serves to detach and unwind the tail end of the web material from the reel as well as position the tail end before applying glue to said reel by means of the glue dispenser, and wherein said vacuum space is arranged upstream of said glue dispenser, said conveying means causing the reel to roll over said glue dispenser, said glue dispenser and said vacuum space being arranged side-by-side.

31. A method for gluing a tail end of wound web material to form a reel in which the tail end is detached from the reel and unwound from the reel to a predetermined length; glue is applied to a portion of the wound web material in order to glue the tail end to the wound web material of the reel; and the tail end is rewound onto the reel, wherein the tail end is detached and unwound from the reel and drawn into a vacuum space by action of a vacuum provided by the vacuum space in an area around the reel and the tail end is further positioned by partially drawing the tail end out of said vacuum space, and the glue is applied on the material still wound on the reel and the reel is made to roll over a glue dispensing slit so that the glue is applied on the reel and the tail end is rewound on the reel.

32. A method for gluing a tail end of wound web material to form a reel, in which the tail end is detached from the reel and unwound from the reel to a predetermined length; glue is applied to a portion of the wound web material in order to glue the tail end to the wound web material of the reel; and the tail end is rewound onto the reel, wherein the tail end is detached and unwound from the reel and drawn into a vacuum space by action of a vacuum provided by the vacuum space in an area around the reel, and the glue is applied on the material still wound on the reel and the reel is made to roll over a glue dispensing slit arranged in said reel conveying surface so that glue is applied on the reel and the tail end is recalled from the vacuum space and rewound on the reel.

* * * * *